US012474102B2

(12) United States Patent
Choi et al.

(10) Patent No.: US 12,474,102 B2
(45) Date of Patent: Nov. 18, 2025

(54) REFRIGERATOR

(71) Applicant: LG ELECTRONICS INC., Seoul (KR)

(72) Inventors: Youji Choi, Seoul (KR); Hyuncheol Lee, Seoul (KR); Kihwang Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 379 days.

(21) Appl. No.: 18/102,485

(22) Filed: Jan. 27, 2023

(65) Prior Publication Data

US 2023/0243562 A1 Aug. 3, 2023

(30) Foreign Application Priority Data

Jan. 28, 2022 (KR) ..... 10-2022-0013466

(51) Int. Cl.
*F25C 1/24* (2018.01)
*F25C 1/04* (2018.01)

(52) U.S. Cl.
CPC ..... *F25C 1/24* (2013.01); *F25C 1/04* (2013.01); *F25C 2400/08* (2013.01); *F25C 2400/10* (2013.01); *F25C 2600/04* (2013.01)

(58) Field of Classification Search
CPC .... F25C 1/24; F25C 1/246; F25C 1/04; F25C 2400/08; F25C 2400/10; F25C 2400/06; F25C 2600/04
See application file for complete search history.

(56) References Cited

U.S. PATENT DOCUMENTS

2016/0252287 A1* 9/2016 Dirnberger ..... F25C 5/06 62/344
2019/0234667 A1 8/2019 Lee et al.
2023/0272956 A1* 8/2023 Jeong ..... F25C 5/22 62/66

FOREIGN PATENT DOCUMENTS

KR 10-2019-0091032 8/2019

* cited by examiner

*Primary Examiner* — Miguel A Diaz
(74) *Attorney, Agent, or Firm* — KED & ASSOCIATES, LLP

(57) ABSTRACT

A refrigerator comprises a freezing compartment having an outlet, through which cold air is discharged, on a rear surface thereof, a first ice maker being mounted on an upper surface of the freezing compartment, and a second ice maker being mounted on the upper surface of the freezing compartment in a way that the second ice maker is spaced from the first ice maker, and further comprises an air guide comprising a first air guide outlet that is disposed to overlap the outlet at least partially and guides a portion of cold air discharged from the outlet to the first ice maker, a second air guide outlet that guides a portion of cold air discharged from the outlet to the second ice maker, and a third air guide outlet that guides a portion of cold air discharged from the outlet between the first ice maker and the second ice maker.

19 Claims, 13 Drawing Sheets

(a)

(b)

REFRIGERATOR

CROSS-REFERENCE TO RELATED APPLICATION(S)

This application claims priority to and the benefit of Korean Patent Application No. 10-2022-0013466, filed in Korea on Jan. 28, 2022, the disclosure of which is incorporated herein by reference in its entirety.

BACKGROUND

1. Field

Disclosed herein is a refrigerator that is provided with a plurality of ice makers, in a single space.

2. Background

Refrigerators generate cold air by circulating refrigerants and provide the cold air to a storage compartment such as a refrigerating compartment or a freezing compartment, to store various types of storage targets for a long period of time and keep the storage targets fresh in the storage compartment. Refrigerators operate based on a refrigeration cycle in which refrigerants pass through a compressor, a condenser, an expansion valve and an evaporator. While refrigerant liquids turn into refrigerant gases in the evaporator, the refrigerants cool the air circulating in the refrigerator to create cold air to be provided to the refrigerating compartment and the freezing compartment is generated.

An ordinary refrigerator comprises an ice maker. The ice maker can generate ice having a predetermined shape and/or size. In recent years, refrigerators having an ice maker respectively at the door thereof and in the freezing compartment thereof have been rolled out. To improve user convenience as well as satisfying user needs, there is a growing demand for a refrigerator that can generate various types of ice and that can be provided with an additional ice maker.

BRIEF DESCRIPTION OF THE DRAWINGS

Embodiments will be described in detail with reference to the following drawings in which like reference numerals refer to like elements, and wherein:

FIG. 3 is a front view showing the refrigerator of one embodiment, and the front surface of the refrigerator without doors, selves, drawers and the like;

DETAILED DESCRIPTION

Figure 1:
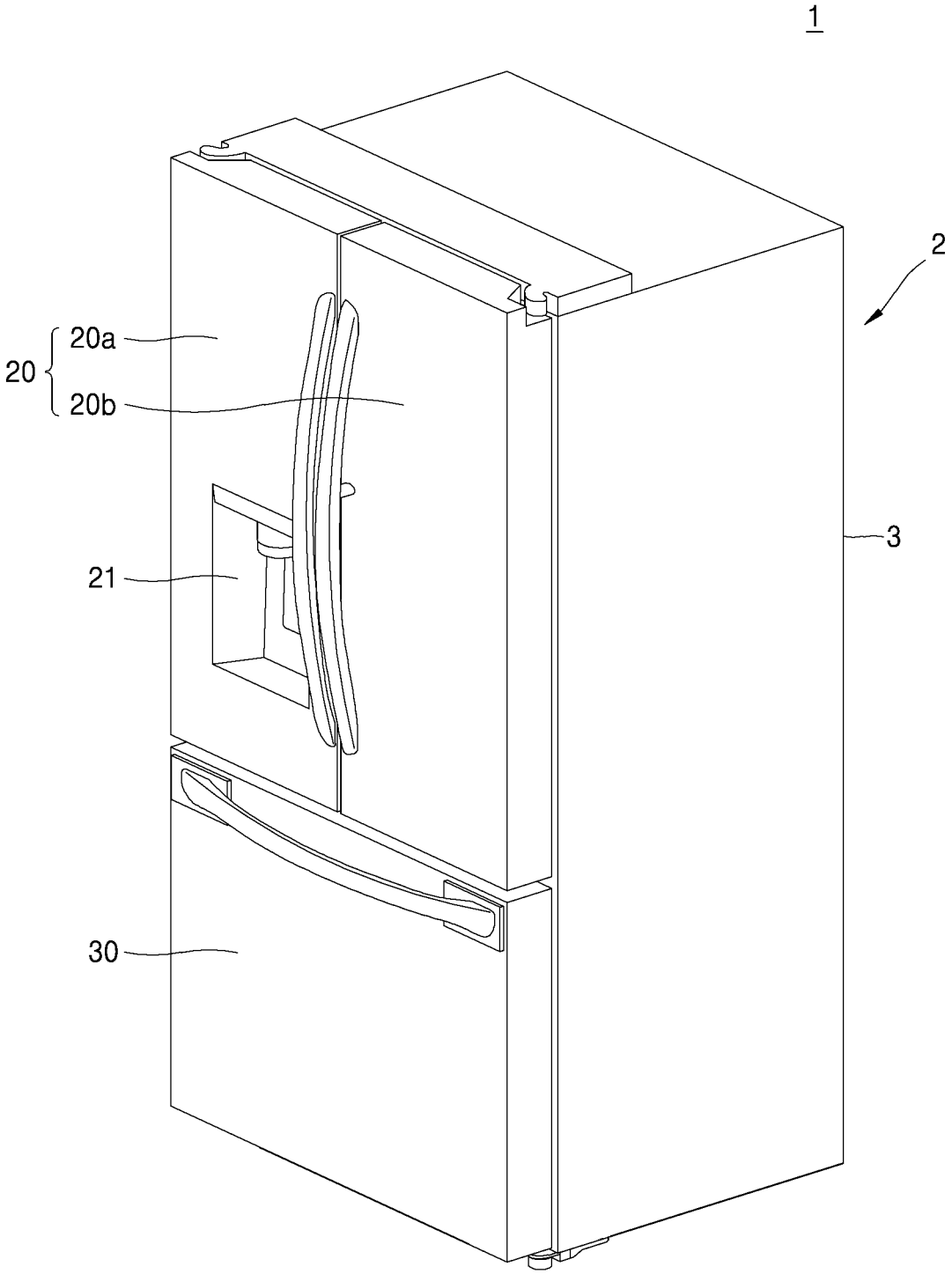
FIG. 1 is a front perspective view showing a refrigerator of one embodiment with doors closed.

The below-described aspects, features and advantages are specifically described hereafter with reference to the accompanying drawings such that one having ordinary skill in the art to which the present disclosure pertains can embody the technical spirit of the disclosure easily. In the disclosure, detailed description of known technologies in relation to the disclosure is omitted if it is deemed to make the gist of the disclosure unnecessarily vague. Hereafter, preferred embodiments according to the disclosure are specifically described with reference to the accompanying drawings. In the drawings, identical reference numerals can denote identical or similar components.

The terms "first", "second" and the like are used herein only to distinguish one component from another component. Thus, the components should not be limited by the terms. Certainly, a first component can be a second component, unless stated to the contrary.

When any one component is described as being "in the upper portion (or lower portion)" or "on (or under)" another component, any one component can be directly on (or under) another component, but an additional component can be interposed between any one component and another component on (or under) any one component. When any one component is described as being "connected", "coupled", or "connected" to another component, any one component can be directly connected or coupled to another component, but an additional component can be "interposed" between the two components or the two components can be "connected", "coupled", or "connected" by an additional component.

Throughout the disclosure, each component can be provided as a single one or a plurality of ones, unless explicitly stated to the contrary. The singular forms "a", "an" and "the" are intended to include the plural forms as well, unless explicitly indicated otherwise. It is to be understood that the terms "comprise" or "include" and the like, set forth herein, are not interpreted as necessarily including all the stated components or steps but can be interpreted as excluding some of the stated components or steps or can be interpreted as including additional components or steps. Throughout the disclosure, the phrase "A and/or B" as used herein can denote A, B or A and B, and the phrase "C to D" can denote C or greater and D or less, unless stated to the contrary.

Figure 2:
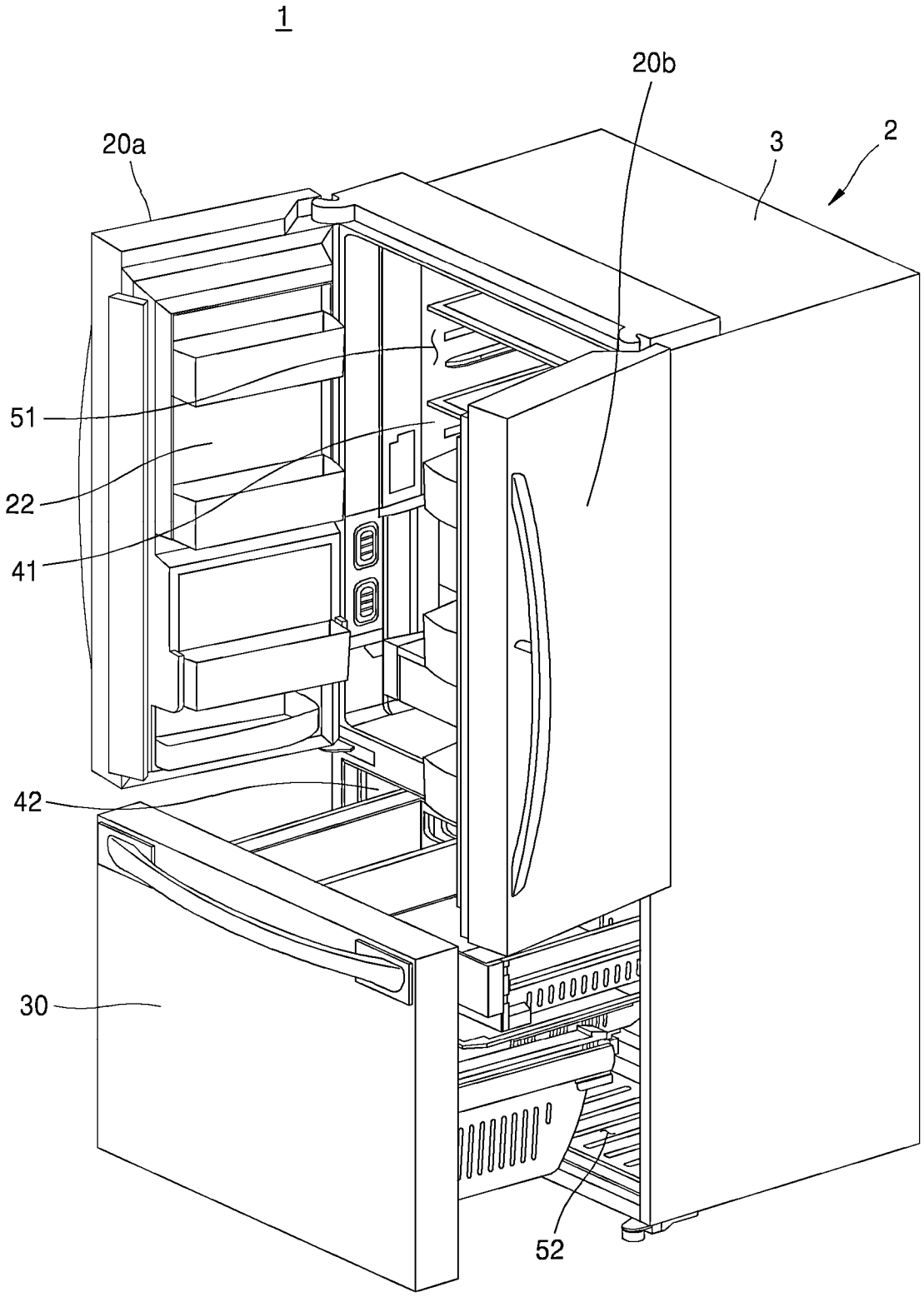
FIG. 2 is a front perspective view showing the refrigerator of one embodiment with the doors open.

Hereafter, a refrigerator of several embodiments is described. FIG. 1 is a front perspective view showing a refrigerator 1 of one embodiment with doors closed, and FIG. 2 is a front perspective view showing the refrigerator 1 of one embodiment with the doors open. The exterior of the refrigerator 1 of one embodiment may be formed by a cabinet 2 forming a storage space, and doors opening and closing the front surface of the cabinet 2, which is open.

The cabinet 2 may comprise an outer case 3 forming the outer surface of the refrigerator 1, and an inner case forming the inner surface of the refrigerator 1. The inner case may comprise a refrigerator case 41 and a freezer case 42. A separation space may be formed between the outer case 3 and the inner case 41, 42 that are spaced from each other. An insulation material may foam in the separation space and fill the vacant space.

The storage space in the cabinet 2 may be portioned into a plurality of spaces, and divided into a refrigerating compartment 51 and a freezing compartment 52. According to the present disclosure, the freezing compartment 52 is disposed in the lower space of the cabinet 2, and the refrigerating compartment 51 is disposed in the upper space of the cabinet 2, in an example.

A door may connect to the front surface of the cabinet 2, and open and close the refrigerator 1. An upper door 20 may be disposed on the front surface of the cabinet 2, which corresponds to the refrigerating compartment 51, and a lower door 30 may be disposed on the front surface of the cabinet 2, which corresponds to the freezing compartment 52. For example, the upper door 20 may be a rotary one comprised of a first upper door 20*a* and a second upper door 20*b* that respectively have a rotation shaft disposed at both sides of the cabinet 2 and rotate. The lower door 30 may be a drawer-type one that moves to be drawn or inserted along a rail, in a sliding manner.

A dispenser part 21 may be disposed at the first upper door 20*a* such that water or ice may be taken out in the state where the door is not open. Additionally, a door ice maker 22 generating ice may be disposed at the first upper door 20*a* at which the dispenser part 21 is disposed.

The refrigerating compartment 51 may be divided into a first storage compartment and a second storage compartment. The second storage compartment may be a pantry compartment the temperature of which is adjusted to accommodate a specific storage target such as vegetables, meat and the like.

The first storage compartment may be a remaining space of the refrigerating compartment 51, except for the second storage compartment, and may be a main storage compartment. For example, the second storage compartment may be disposed under the first storage compartment and be separated from the first storage compartment by an additional partition member.

A storage drawer may be disposed in the second storage compartment in a way that the storage compartment is drawn or inserted along a rail, in a sliding manner. Additionally, a storage drawer and/or a shelf is provided in the first storage compartment to accommodate and store a storage target readily.

The first storage compartment and the second storage compartment may respectively be provided with an additional temperature sensor, such that the temperatures of the first storage compartment and the second storage compartment are adjusted independently, enabling the first storage compartment and the second storage compartment to have a different temperature.

Figure 3:
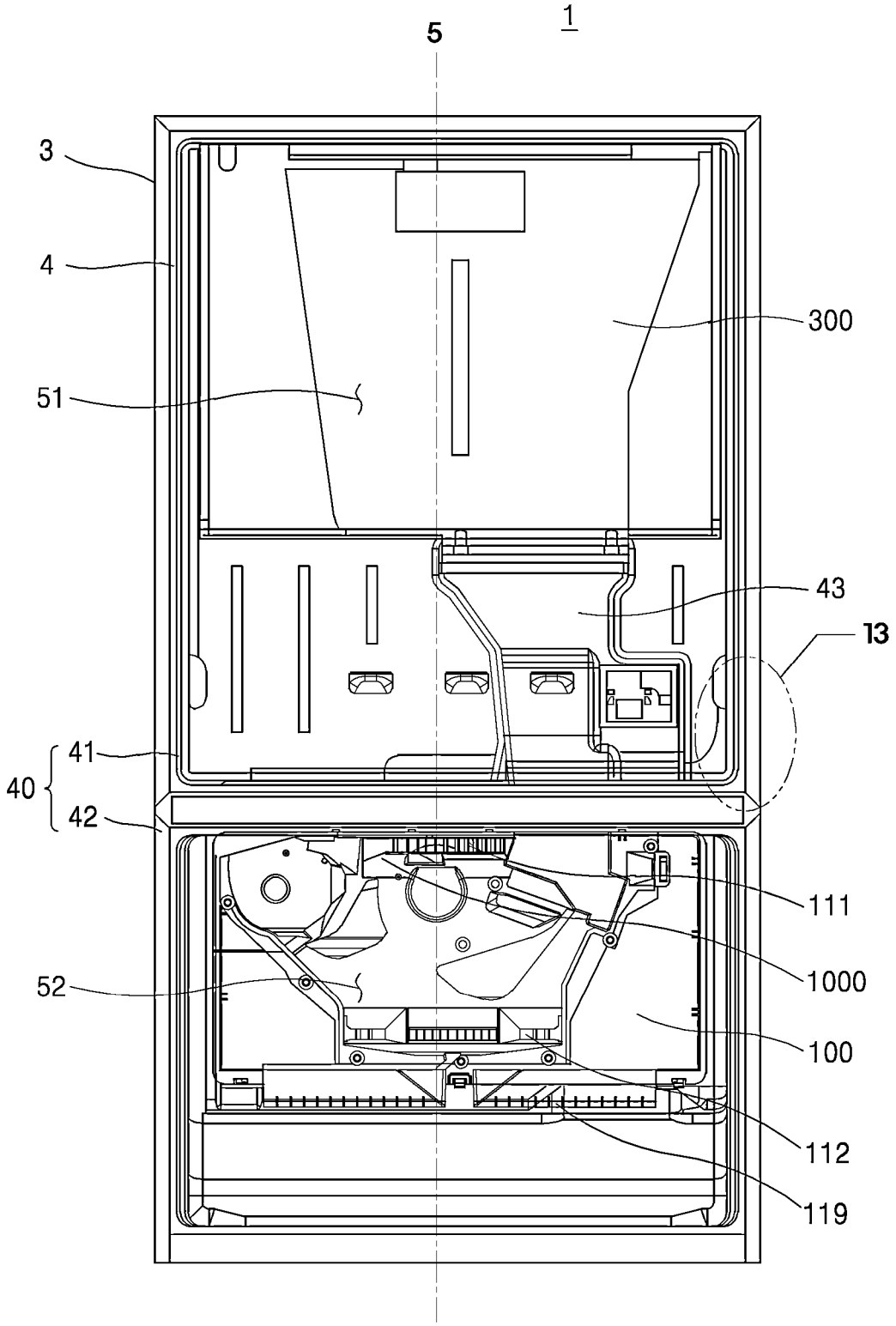
Figure 4:
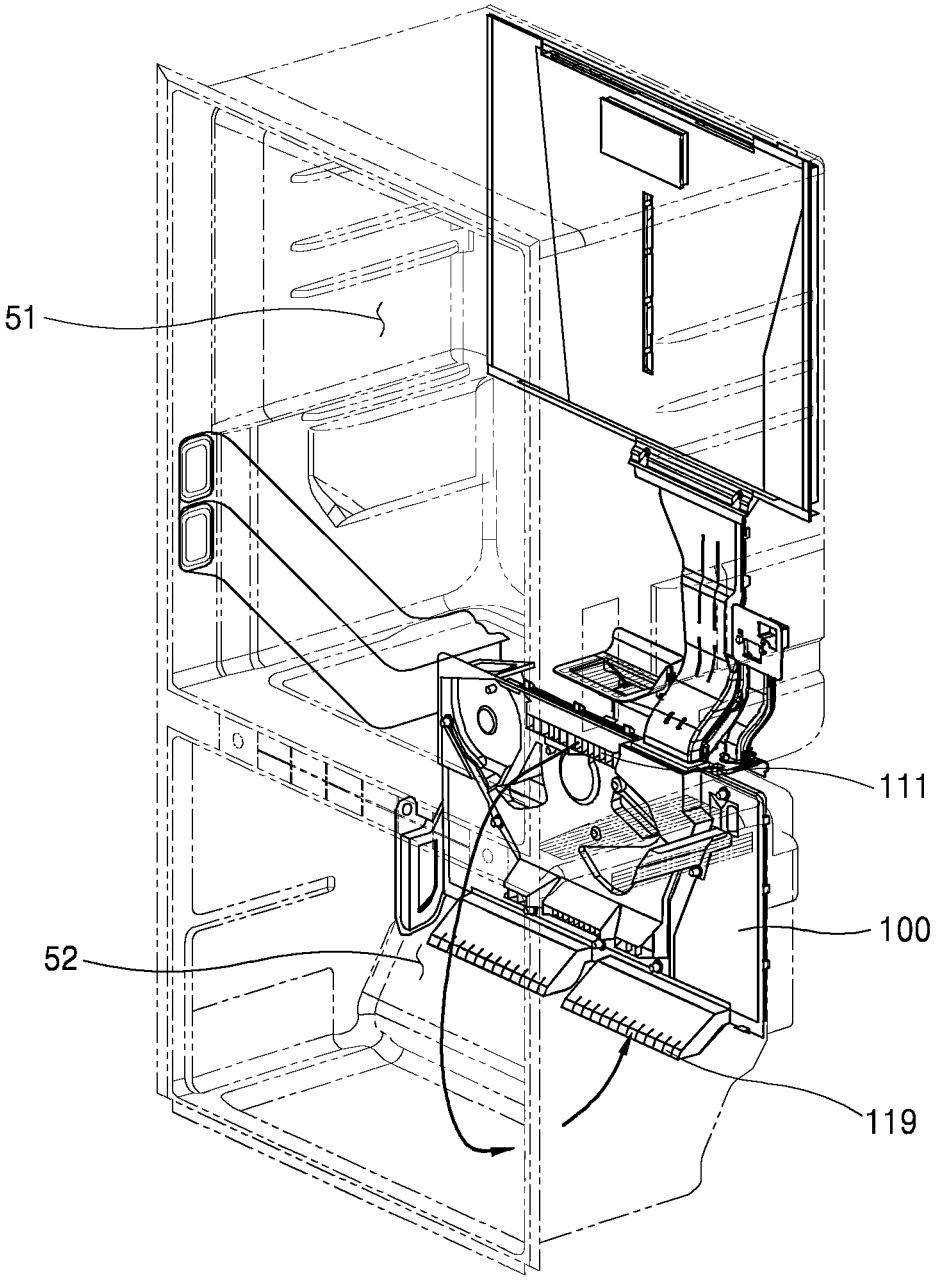
FIG. 4 is a front perspective view showing a cold air circulation structure of a freezing compartment.
Figure 5:
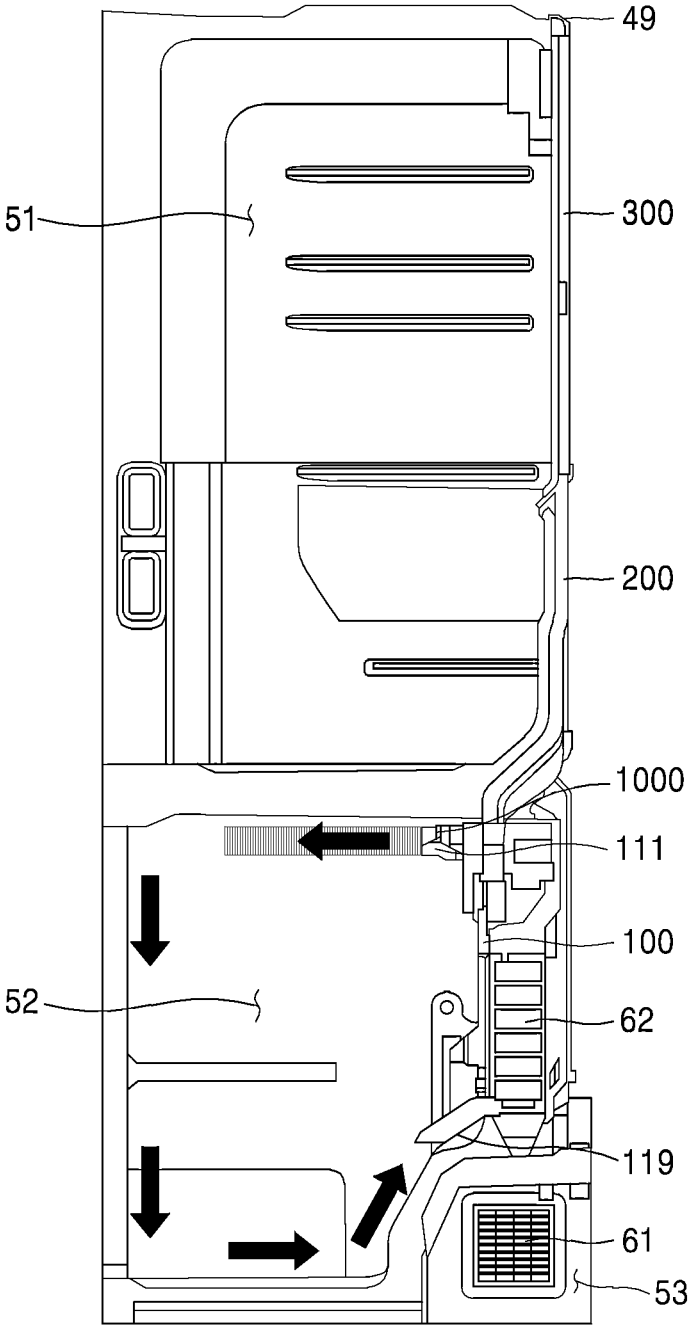
FIG. 5 is a cross-sectional view showing a cold air return structure of a freezing compartment.

FIG. 3 is a front view showing the refrigerator of one embodiment, and the front surface of the refrigerator without doors, selves, drawers and the like, FIG. 4 is a front perspective view showing a cold air circulation structure of a freezing compartment, and FIG. 5 is a cross-sectional view showing a cold air return structure of a freezing compartment and is a lateral cross-sectional view along line 5 in FIG. 3.

The inner case 40 may comprise a refrigerator case 41 being disposed in the upper portion of the refrigerator and constituting the refrigerating compartment 51, and a freeze case 42 being disposed in the lower portion of the refrigerator and constituting the freezing compartment 52. The refrigerator case 41 may form the refrigerating compartment 51, and the freezer case 42 may form the freezer case 52. A refrigerating compartment cold air supply duct 300 for supplying cold air to the refrigerating compartment 51 may be disposed in the upper portion of the rear surface of the refrigerator case 41. A controller that sets a set value and the like required for the operation of the refrigerator 1 may be disposed on one lateral surface 13 of the refrigerator case 41.

A grille fan assembly 100 may be disposed on the rear surface of the freezer case 42. The grille fan assembly 100 may comprise a grille fan upper outlet 111 and a grille fan lower outlet 112 that discharge cold air to the freezing compartment 52, and an inlet 119 into which cold air in the freezing compartment 52 is suctioned.

Cold air generated by the evaporator 62 may be supplied to both the refrigerating compartment 51 and the freezing compartment 52. In the case where a door ice maker 22 is additionally provided at the upper door 20 of the refrigerator 1, cold air generated by a single evaporator 62 may be supplied to all of the refrigerating compartment 51, the freezing compartment 52 and the door ice maker 22.

The evaporator 62 generating cold air may be disposed in the freezing compartment 52. Specifically, the evaporator 62 may be disposed on the rear surface of the freezer case 42. The evaporator 62 may be disposed over a machine room 53. The machine room 53 may be provided at the rear side of the lower portion of the freezer case 42 and provide a space in which a compressor 61 and a condenser are installed.

The rear space of the lower side in the freezing compartment 52 may have a smaller freezer space than the rear space of the upper side in the freezing compartment 52, because of the space occupied by the machine room 53. That is, the area of the upper surface of the freezer case may be greater than the area of the lower surface of the freezer case. Accordingly, the area of the upper side of the freezing compartment 52 may protrude further rearward than the area of the lower side of the freezing compartment 52, and the evaporator 62 may be disposed in the rear space of the upper side of the freezing compartment 52.

The grille fan assembly (or evaporator cover) 100 may be disposed on the front surface of the evaporator 62. The grille fan assembly 100 blows cold air generated from the evaporator 62 to the refrigerating compartment 51 and the freezing compartment 52.

If the upper door 20 of the refrigerator 1 is provided with a door ice maker 22, cold air generated from a single evaporator 62 may be blown to all of the refrigerating compartment 51, the freezing compartment 52, and the door ice maker 22 from a single grille fan assembly 100.

To blow cold air to the refrigerating compartment cold air supply duct 300 supplying cold air to the refrigerating compartment 51, a connection duct 200 illustrated) may be additionally disposed between the grille fan assembly 100 and the refrigerating compartment cold air supply duct 300. The connection duct 200 may be disposed at the rear of a rear surface protrusion part 43 that protrudes toward the inside of the refrigerator case 41. The rear surface protrusion part 43 may have a shape corresponding to the shape of the connection duct 200 such that the connection duct (not illustrated) may be disposed at the rear of the rear surface protrusion part 43. The rear surface protrusion part 43 may be formed to extend along the rear surface of the refrigerator case 41 from the lower surface of the refrigerator case 41 toward the upper surface of the refrigerator case 41.

One end of the connection duct 200 may connect to the grille fan assembly 100, and the other end of the connection duct 200 may connect to the refrigerating compartment cold air supply duct 300, such that cold air blowing from the grille fan assembly 100 is guided to the refrigerating compartment cold air supply duct 300. The refrigerating compartment cold air supply duct 300 may be disposed inside the refrigerator case 41, the connection duct 200 may be disposed outside the refrigerator case 41, and the refrigerating compartment cold air supply duct 300 and the connection duct 200 may communicate with each other on the rear surface of the refrigerator case.

For the refrigerator 1 to have a thermal insulation effect, an insulation material 4 exhibiting a very low heat conductivity may foam between the inner case 40 and the outer case 3 and fill a space between the inner case 40 and the outer case 3. The connection duct 200 may be disposed to pass through the space between the inner case 40 and the outer case 3, which foams with the insulation material 4. Accordingly, as the upper door 20 of the refrigerator 1 is opened, the connection duct 200 disposed outside the refrigerator case 41 may not be exposed outward, while the refrigerating compartment cold air supply duct 300 disposed inside the refrigerator case 41 may be exposed outward.

Hereafter, the flow of cold air in the freezing compartment is described. Cold air generated from the evaporator 62 disposed in the freezing compartment 52 may be supplied to the freezing compartment 52 by the grille fan assembly 100 disposed in the freezing compartment 52. The grille fan assembly 100 may comprise a grille fan upper outlet 111 that discharges cold air toward the front surface of the freezing compartment 52, in the upper area of the freezing compartment 52.

Cold air, discharged toward the front surface of the freezing compartment 52 in the upper area of the freezing compartment 52, circulates in the freezing compartment 52, and returns toward the rear surface of the freezing compartment 52 in the lower area of the freezing compartment 52. Since the machine room 53 is provided at the rear side of the lower portion of the freezing compartment 52, the rear surface of the lower side of the freezing compartment 52 may be an inclined surface that is formed at a slant from the lower portion thereof toward the upper portion thereof. Thus, in the lower area of the freezing compartment 52, cold air, returning toward the rear surface of the freezing compartment 52, may be drawn and returned into the cold air inlet 119 of the grille fan assembly 100, along the inclined surface of the rear surface of the freezing compartment 52.

An air guide 1000 may be disposed at the front of the grille fan upper outlet 111. The configuration and function of the air guide 1000 are specifically described, hereafter. A refrigerator that uses a single evaporator 62 to supply cold air to the refrigerating compartment 51 and the freezing compartment 52 is described above as an example, but not limited in the present disclosure. For example, the refrigerator of one embodiment may comprise an evaporator for a refrigerating compartment, and an evaporator for a freezing compartment.

Figure 6:
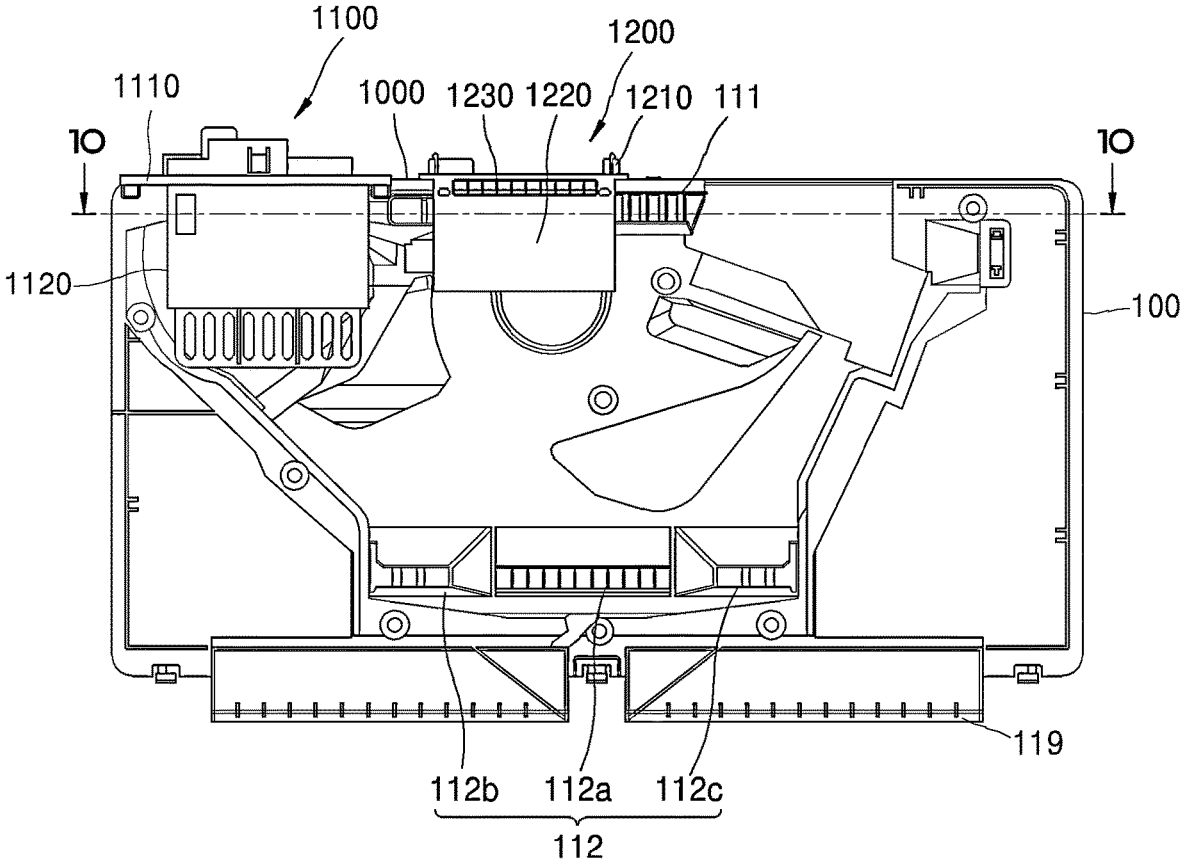
FIG. 6 is a view showing a portion of the configuration of a freezer comportment of the refrigerator of one embodiment.
Figure 7:
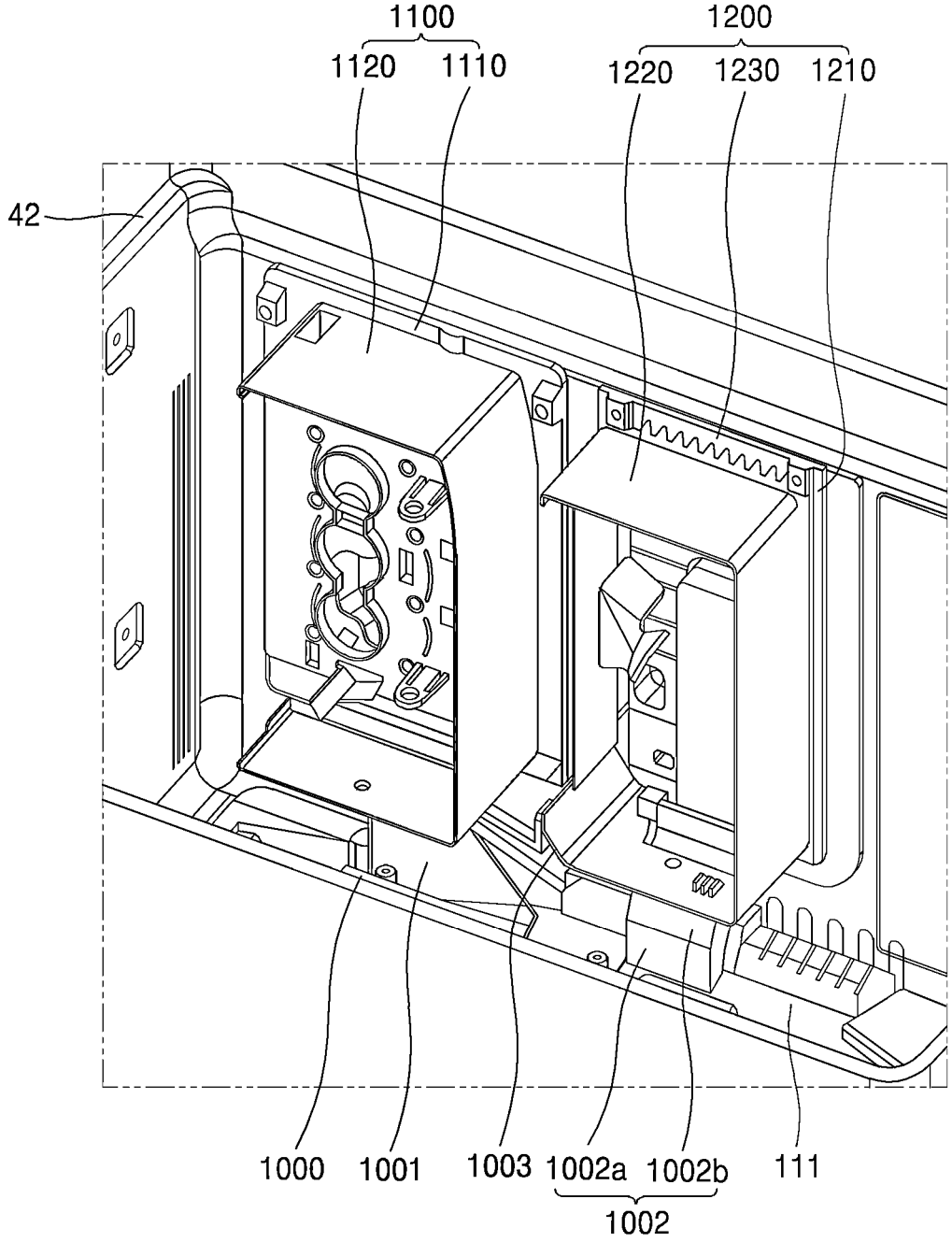
FIG. 7 is a perspective view showing the configuration in which a first ice maker and a second ice maker of the refrigerator of one embodiment are mounted, when viewed from the front of the lower side thereof.
Figure 8:
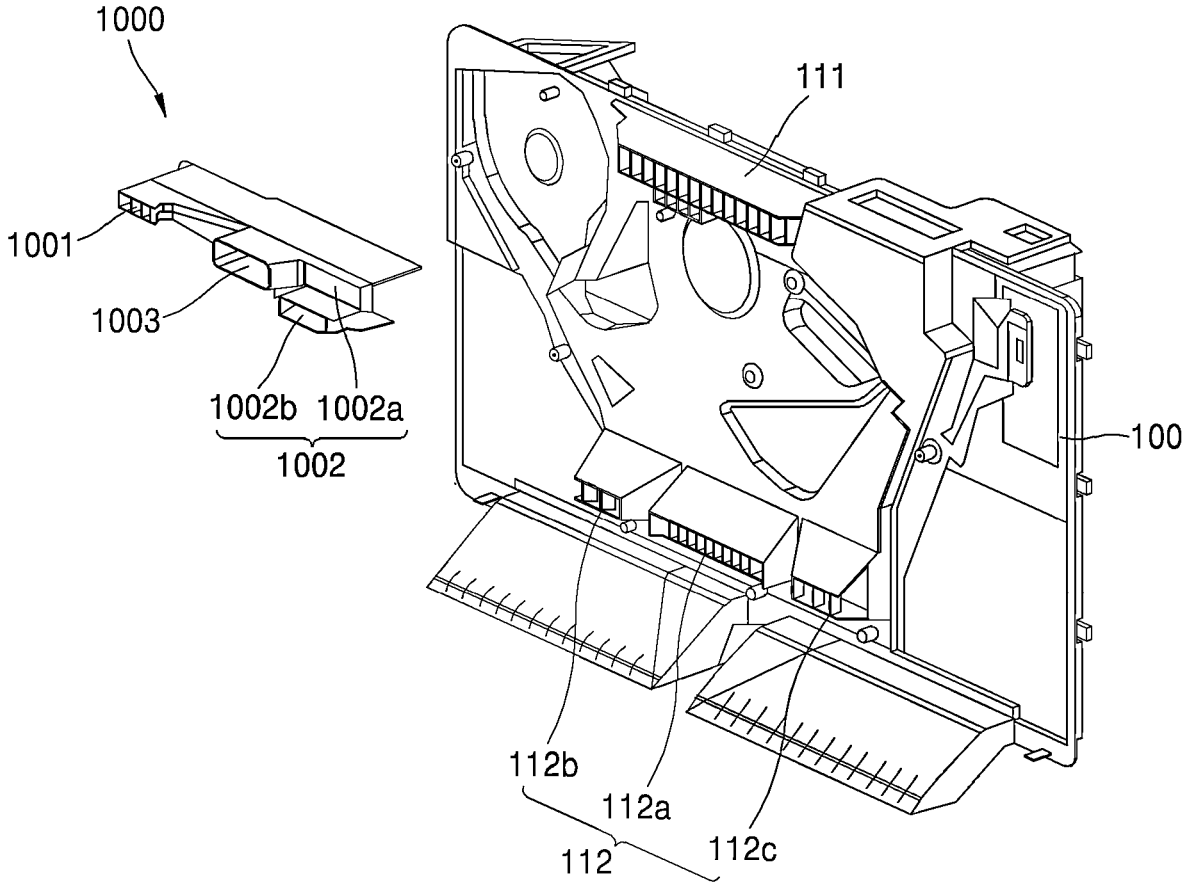
FIG. 8 is an exploded perspective view showing a grille fan assembly and an air guide of the refrigerator of one embodiment.
Figure 9:
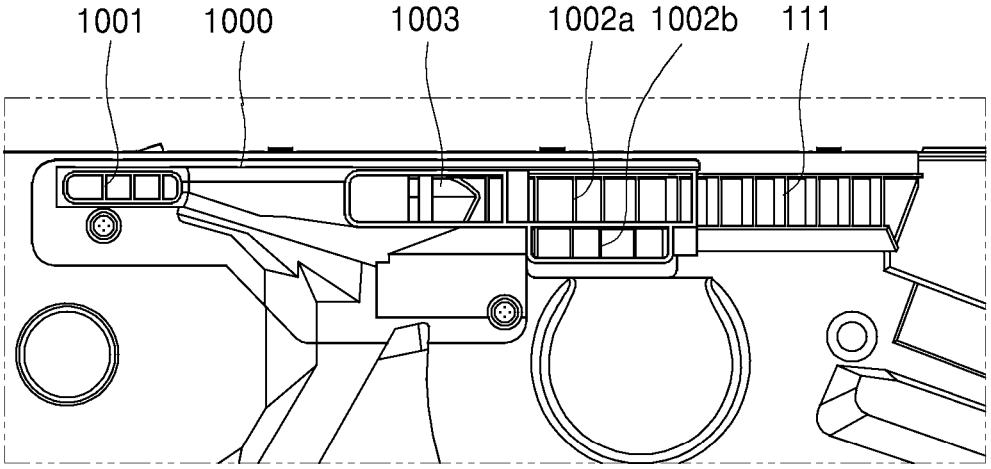
FIG. 9 is an enlarged view showing the portion where the grille fan assembly and the air guide of the refrigerator of one embodiment are coupled.

FIG. 6 is a view showing a portion of the configuration of a freezer comportment of the refrigerator of one embodiment, FIG. 7 is a perspective view showing the freezer comportment in which a first ice maker 1100 and a second ice maker 1200 of the refrigerator of one embodiment are mounted, when viewed from the front of the lower side thereof, FIG. 8 is an exploded perspective view showing a grille fan assembly and an air guide of the refrigerator of one embodiment, and FIG. 9 is an enlarged view showing the portion where the grille fan assembly and the air guide of the refrigerator of one embodiment are coupled. A grille fan assembly 100, an air guide 1000, a first ice maker 1100, and a second ice maker 1200 may be provided in the freezing compartment of the refrigerator of one embodiment.

The grille fan assembly 100 may comprise a grille fan upper outlet 111, a grille fan lower outlet 112 and a cold air inlet 119, while the grille fan lower outlet 112 may comprise a first grille fan lower outlet 112*a*, a second grille fan lower outlet 112*b* and a third grille fan lower outlet 112*c*. The first ice maker 1100 may comprise a first ice maker fixation part (or first ice maker fixation bracket) 1110, and a first ice maker housing 1120, and the second ice maker 1200 may comprise a second ice maker fixation part (or second ice maker fixation bracket) 1210 and a second ice maker housing 1220. As described above, the grille fan assembly 100 may be fixed to the rear surface of the freezer case 42. The grille fan upper outlet 111 may be disposed over the grille fan assembly 100 and discharge cold air.

Referring to FIGS. 6 and 7, the first ice maker 1100 may be biased toward one side of the freezing compartment 52. When viewed from the front, the first ice maker 1100 may be disposed at the left side of the freezing compartment 52, for example. The first ice maker 1100 may generate ice having a first shape. The first ice maker fixation part 1110 may fix the first ice maker 1100 to one surface of the freezer case 42. For example, the first ice maker fixation part 1110 may be coupled to the upper surface of the freezer case 42, to fix the first ice maker 1100 to the upper surface of the freezer case 42. The first ice maker housing 1120 may be disposed at one side of the first ice maker 1100 and form a space in which a first tray (not illustrated) and a first water supply device (not illustrated) are disposed. Ice is generated in the first tray (not illustrated), and the first water supply device (not illustrated) supplies water to the first tray (not illustrated). The first ice maker housing 1120 may be disposed at the lower side of the first ice maker fixation part 1110, and may be formed into an approximate cuboid as a whole.

The second ice maker 1200 may be spaced from the first ice maker 1100, and disposed closer the center of the freezing compartment 52 than the first ice maker 1100. For example, when viewed from the front, the second ice maker 1200 may be disposed at the right side of the first ice maker 1100. The second ice maker 1200 may generate ice having a second shape. The second ice maker fixation part 1210 may fix the second ice maker 1200 to one surface of the freezer case 42. For example, the second ice maker fixation part 1210 may be coupled to the upper surface of the freezer case 42 to fix the second ice maker 1200 to the upper surface of the freezer case 42.

The second ice maker housing 1220 may be disposed at one side of the first ice maker 1100 and form a space in which a second tray 1240 and a second water supply device (not illustrated) are disposed. Ice is generated in the second tray 1240, and the second water supply device (not illustrated) supplies water to the second tray 1240. For example, the second ice maker housing 1220 may be at the lower side of the second ice maker fixation part 1210 and formed into an approximate cuboid as a whole. A second ice maker outlet 1230 may be formed on the front surface of the second ice maker housing 1220 such that cold air drawn into the second ice maker housing 1220 is discharged to the front surface of the second ice maker housing 1220.

The first shape and the second shape may differ. For example, the first shape may be a relatively large and circular shape, and the second shape may be a relatively small and cuboid shape, but not limited in the present disclosure. For example, the first shape and the second shape may be the same shape.

Referring to FIGS. 8 and 9, the air guide 1000 may discharge at least a portion of the cold air discharged from the grille fan upper outlet 111 in at least three directions. To this end, the air guide 1000 may comprise a first air guide outlet 1001, a second air guide outlet 1002, and a third air guide outlet 1003. The second air guide outlet 1002 may comprise a second air guide upper outlet 1002*a* and a second air guide lower outlet 1002*b*. The first air guide outlet 1001 may be disposed at one side of the air guide 1000. For example, the first air guide outlet 1001 may be disposed at the front of the left side of the air guide 1000. The second air guide outlet 1002 may be disposed at one side of the air guide 1000. For example, the second air guide outlet 1002 may be at the front of the right side of the air guide 1000. The second air guide lower outlet 1002*b* may be disposed under the second air guide upper outlet 1002*a*. The third air guide outlet 1003 may be disposed between the first air guide outlet 1001 and the second air guide outlet 1002.

The air guide 1000 may be fixed to the front surface of the grille fan assembly 100. Specifically, the air guide 1000 may be fixed to the front surface of the grille fan assembly 100 in a way that at least a portion of the air guide 1000 covers a portion of the grille fan upper outlet 111, when viewed from the front.

Referring back to FIG. 7, the first air guide outlet 1001 may guide a portion of the cold air discharged from the grille fan upper outlet 111 to the first ice maker 1100. The second air guide outlet 1002 may guide a portion of the cold air discharged from the grille fan upper outlet 111 to the second ice maker 1200. The second air guide upper outlet 1002*a* may guide cold air to the upper side of the space formed by the second ice maker housing 1220 of the second ice maker 1200. Most of the cold air discharged from the second air guide upper outlet 1002*a* may be discharged to the front surface of the second ice maker 1200 through the second ice maker outlet 1230. The second air guide lower outlet 1002*b* may discharge cold air to the space formed by the second ice maker housing 1220 of the second ice maker 1200. Most of the cold air discharged from the second air guide lower outlet 1002*b* may be used to generate ice in the second ice maker 1200. That is, most of the cold air discharged from the second air guide lower outlet 1002*b* may flow toward the second tray 1240 in the second ice maker housing 1220. The third air guide outlet 1003 may discharge cold air between the first ice maker 1100 and the second ice maker 1200.

Referring to FIGS. 6 and 8, the grille fan assembly 100 may comprise a grille fan lower outlet 112. The grille fan lower outlet 112 may be disposed below the grille fan upper outlet 111. As illustrated, the grille fan lower outlet 112 may be disposed blow the middle of the grille fan assembly 100 with respect to the up-down direction. The grille fan lower outlet 112 may discharge cold air to the lower area of the freezing compartment.

The grille fan lower outlet 112 may comprise a first grille fan lower outlet 112*a* that discharges cold air toward the front, a second grille fan lower outlet 112*b* that is disposed at the left side of the first grille fan lower outlet 112*a*, when viewed from the front, and discharges cold air between the front and the left side, and a third grille fan lower outlet 112*c* that is disposed at the right side of the first grille fan lower outlet 112*a*, when viewed from the front, and discharges cold air between the front and the left side.

Figure 10:
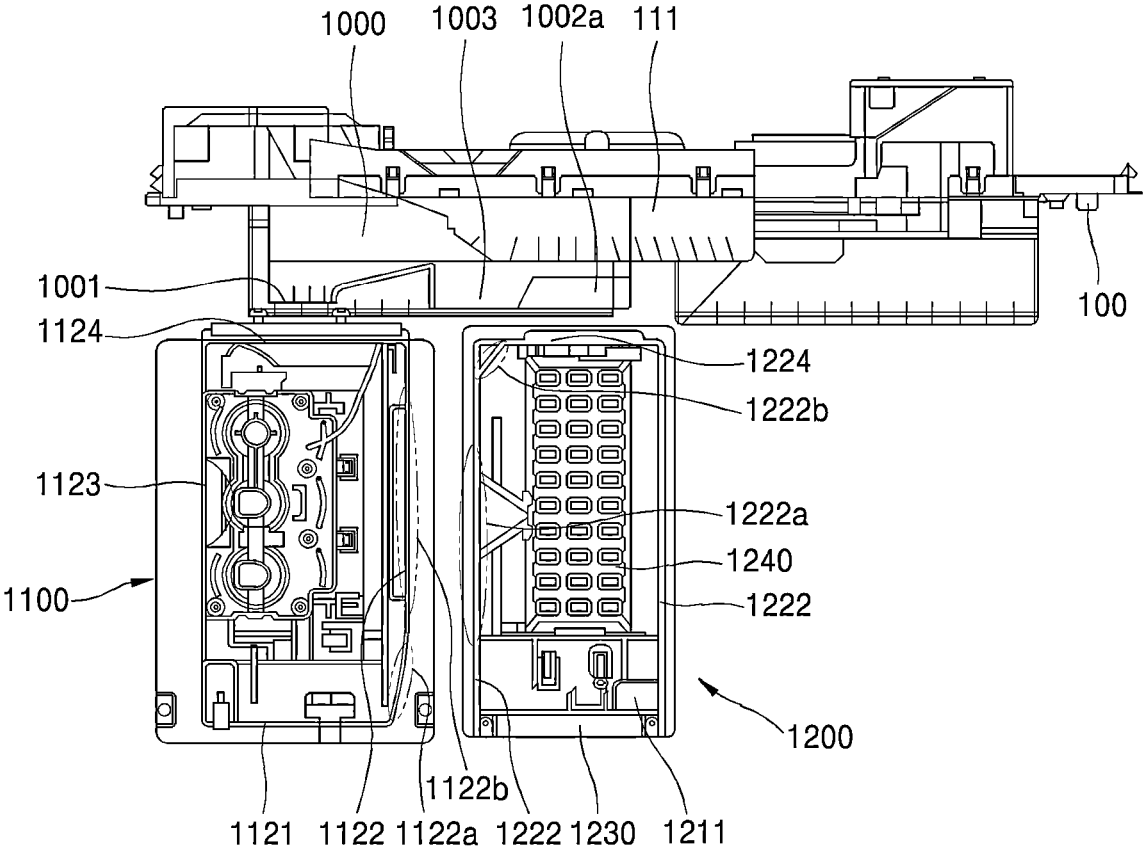
FIG. 10 is a cross-sectional view showing a cross section along 10-10' in FIG. 6.

FIG. 10 is a cross-sectional view showing a cross section along 10-10' in FIG. 6. As described above, the air guide 1000 may be mounted on the grille fan assembly 100 in a way that the air guide 1000 overlaps the grille fan upper outlet 111 of the grille fan assembly 100 at least partially. The first air guide outlet 1001 of the air guide 100 may supply cold air to the first ice maker 1100. The second air guide outlet 1002 may supply cold air to the second ice maker 1200. The third air guide outlet 1003 may supply cold air between the first ice maker 1100 and the second ice maker 1200.

The first ice maker housing (1120 in FIGS. 6 and 7) of the first ice maker 1100 may comprise a first front surface 1121, a 1-1 lateral surface (or first lateral surface) 1122, a 1-2 lateral surface (or second lateral surface) 1123, and a first rear surface 1124. An inlet hole into which cold air discharged from the first air guide outlet 1001 flows may be formed on the first rear surface 1124. The first front surface 1121, the 1-2 lateral surface 1123 and the first rear surface 1124 may be formed into a flat surface entirely. The 1-1 lateral surface 1122 is a surface adjacent to the second ice maker 1200. A distance from a portion of the 1-1 lateral surface 1122, which is adjacent to the air guide 1000, to the second ice maker 1200 may be less than a distance from a portion of the 1-1 lateral surface 1122, which is far from the air guide 1000, to the second ice maker 1200. That is, as the 1-1 lateral surface 1122 becomes farther from the air guide 1000, the 1-1 lateral surface 1122 may become farther from the second ice maker 1200.

The 1-1 lateral surface 1122, as illustrated in FIG. 10, may have a 1-1 lateral surface front part (or first lateral surface first sub-region) 1122*a* that is spaced a predetermined distance apart from a portion far from the air guide 1000, i.e., a portion adjacent to the first front surface 1121, and a 1-1 lateral surface rear part (or first lateral surface second sub-region) 1122*b* that is spaced a predetermined distance apart from a portion adjacent to the first rear surface 1124. As the 1-1 lateral surface front part 1122*a* becomes farther from the air guide 1000, the 1-1 lateral surface front part 1122*a* may be formed in a way that a distance between the 1-1 lateral surface front part 1122*a* and the second ice maker 1200 increases while the 1-1 lateral surface front part 1122*a* is formed into a curved surface entirely, when viewed from above. In other words, the 1-1 lateral surface front part 1122*a* bends in the direction of the lateral surface of the freezing compartment 52, further toward the front. The 1-1 lateral surface rear part 1122*b* may be formed into a straight line entirely. That is, a distance between the 1-1 lateral surface rear part 1122*b* and the second ice maker may remain constant. Since the 1-1 lateral surface front part 1122*a* is formed as described above, more cold air may flow to the front of the first ice maker 1100.

The second ice maker housing (1220 in FIGS. 6 and 7) of the second ice maker 1200 may comprise a second front surface 1221, a 2-1 lateral surface (or first lateral surface) 1222, a 2-2 lateral surface (or second lateral surface) 1223 and a second rear surface 1124. An inlet hole into which cold air discharged from the second air guide outlet 1002 flows may be formed on the second rear surface 1224. The second front surface 1221, the 2-2 lateral surface 1223 and the second rear surface 1224 may be formed into a flat surface entirely. The 1-1 lateral surface 1122 is a surface adjacent to the second ice maker 1200. The 2-1 lateral surface 1222 is a surface adjacent to the first ice maker 1100. A distance from a portion of the 2-1 lateral surface 1222, which is adjacent to the air guide 1000, to the first ice maker 1100 may be greater than a distance from a portion of the 2-1 lateral surface 1222, which is far from the air guide 1000, to the first ice maker 1100. That is, as the 2-1 lateral surface 1222 becomes closer to the air guide 1000, the 2-1 lateral surface 1222 may become farther from the first ice maker 1100.

The 2-1 lateral surface 1222, as illustrated in FIG. 10, may have a 2-1 lateral surface rear part (or first lateral surface rear sub-region) 1222*b* that is spaced a predetermined distance apart from a portion close to the air guide 1000, i.e., a portion adjacent to the rear surface 1224, and a 2-1 lateral surface front part (or first lateral surface front sub-region) 1222*a* that is spaced a predetermined distance apart from a portion far from the air guide 1000, i.e., a portion adjacent to the front surface 1221. As the 2-1 lateral surface rear part 1222*b* becomes closer to the air guide 1000, the 2-1 lateral surface rear part 1222*b* may be formed in a way that a distance between the 2-1 lateral surface rear part 1222*b* and the first ice maker 1100 increases. The 2-1 lateral surface rear part 1222*b* may be formed into a flat surface entirely. In other words, the 2-1 lateral surface rear part 1222*b* may face the center of the freezing compartment 52 further toward the rear. The 2-1 lateral surface front part 1222*a* may be formed into a straight line entirely. That is, a distance between the 2-1 lateral surface front part 1122*b* and the first ice maker may remain constant.

Since the 2-1 lateral surface front part 1122*b* is formed as described above, the failure of a sufficient flow of cold air, discharged from the third air guide outlet 1003, in the freezing compartment 52 due to a collision between the cold air and the second ice maker housing 1220 may be prevented, and more cold air may flow between the first ice maker 1100 and the second ice maker 1200.

Figure 11:
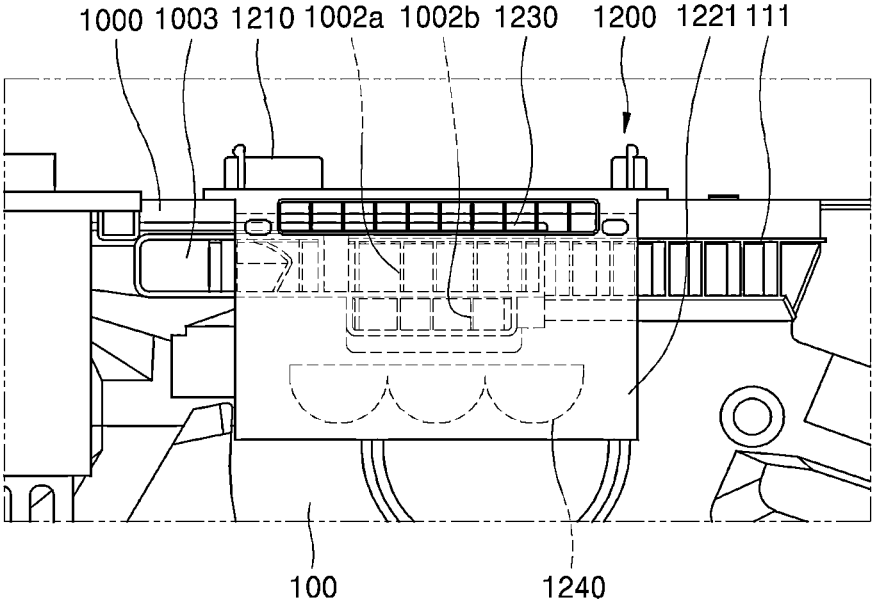
FIG. 11 is an enlarged view showing the second ice maker portion in FIG. 6.

FIG. 11 is an enlarged view showing the second ice maker 1200 portion in FIG. 6. As describe above, the second air guide outlet 1002 of the air guide 1000 may comprise the second air guide upper outlet 1002*a* and the second air guide lower outlet 1002*b* disposed under the second air guide upper outlet 1002*a*. The second ice maker outlet 1230 may be formed on the front surface of the second ice maker housing 1220 of the second ice maker 1200.

When viewed from the front, the second air guide upper outlet 1002*a* may overlap the second ice maker outlet 1230 partially. Cold air discharged from the second air guide upper outlet 1002*a* may flow in the upper portion of the space formed by the second air guide housing 1220. Most of the cold air discharged from the second air guide upper outlet 1002*a* may be discharged immediately to the second ice maker outlet 1230, without contacting another structure and the like. Thus, a sufficient amount of cold air may be supplied to the front of the second ice maker 1200.

Most of the cold air discharged from the second air guide lower outlet 1002*b* flows on the upper surface of a tray 1240 in the second air guide housing 1220. As a result, water in the tray 1240 in the second air guide housing 1220 may become ice rapidly.

Figure 12:
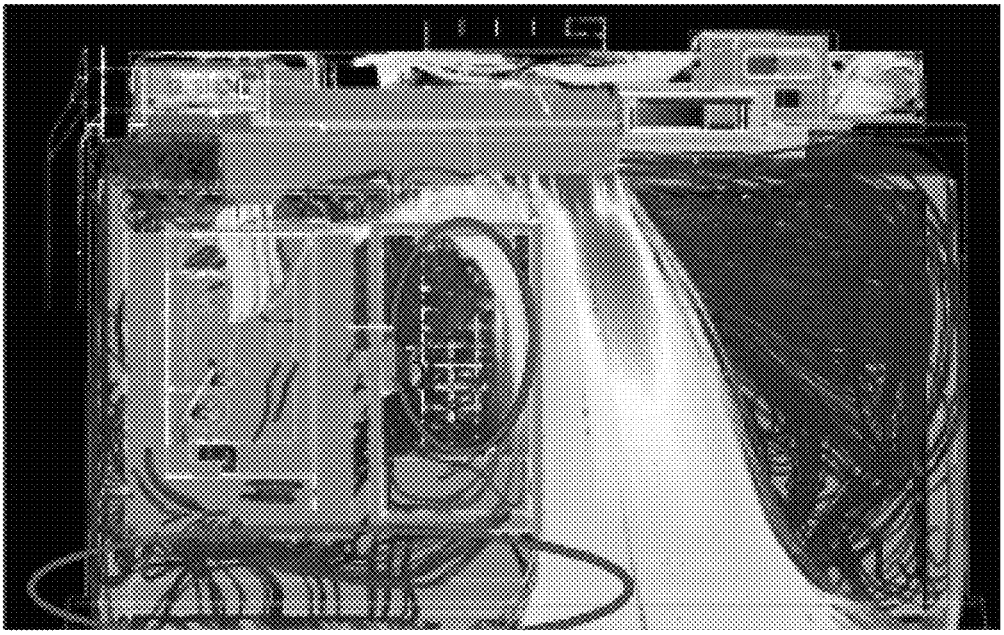
FIG. 12 is a black and white photograph that shows results of simulation of the flow of cold air in the freezer comportment of the refrigerator of one embodiment.
Figure 12:
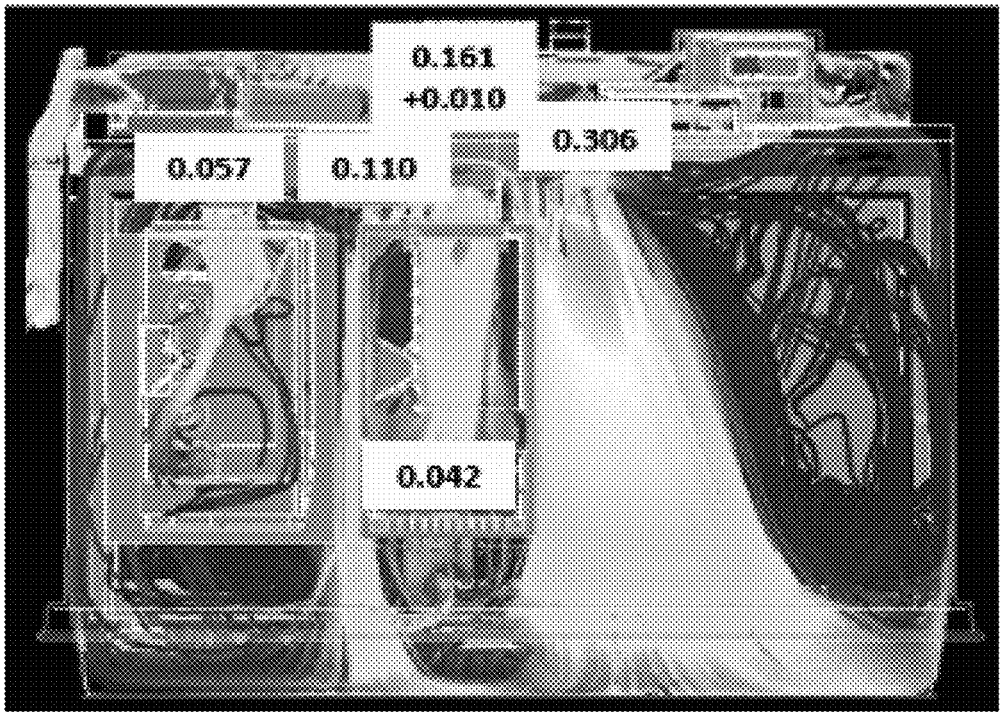

FIG. 12 is a black and white photograph that shows results of simulation of the flow of cold air in the freezer comportment of the refrigerator of one embodiment. In a comparative example, FIG. 12 (region a) shows results of simulation in the case where the 1-1 lateral surface 1121 of the first ice maker housing 1120, and the 2-1 lateral surface 1221 of the second ice maker housing 1220 are formed into a flat surface, the second ice maker outlet 1230 is not formed, and the air guide 1000 has a single outlet, while FIG. 12 (region b) shows results of simulation of the refrigerator of one embodiment.

In FIG. 12 (region a), cold air is not sufficiently supplied into the second ice maker, and to the fronts of the first ice maker and the second ice maker. At this time, ice may be generated slowly in the second ice maker, and frost and the like is highly likely to be formed at the fronts of the first ice maker and the second ice maker. In FIG. 12 (region b), cold air is sufficiently supplied into the second ice maker and to the fronts of the first ice maker and the second ice maker. Thus, the above-mentioned problem can be solved.

The first ice maker 1100 and the second ice maker 1200 disposed in the freezing compartment 52 are described above, for example, but may be disposed in another space of the refrigerator. For example, two ice makers may be disposed at the first upper door 20*a* where the dispenser part 21 is disposed.

Figure 13:
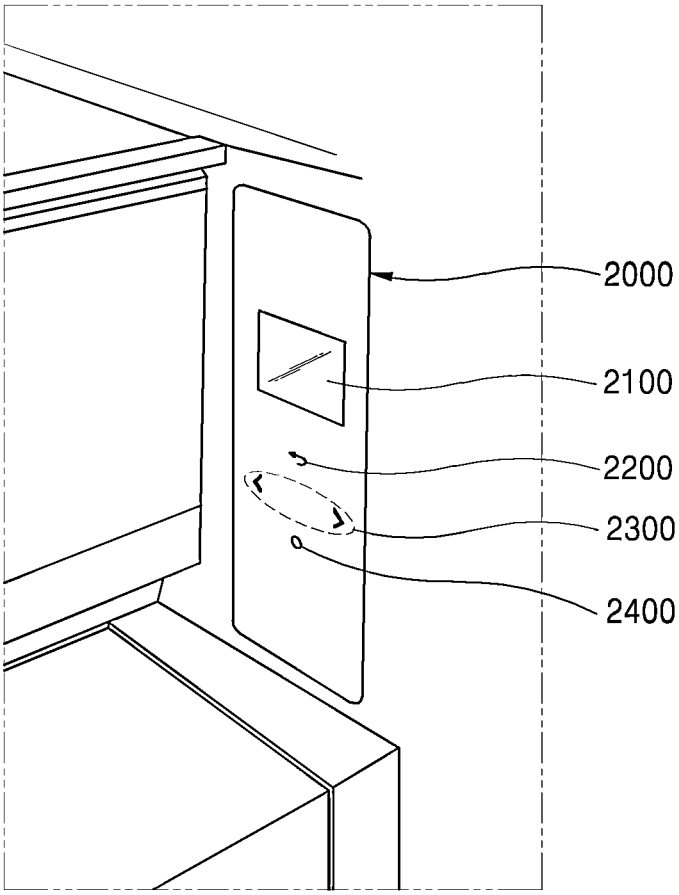
FIG. 13 is an enlarged view showing portion 13 in FIG. 3.

FIG. 13 is an enlarged view showing portion 13 in FIG. 3 and shows a control panel 2000 of the refrigerator of one embodiment. In one embodiment, the control panel 2000 may be disposed on one lateral surface of the refrigerator case 41, as described above. The control panel 2000 may comprise a display part 2100 and an input part. The input part may comprise a return input button 2200, a selection button 2300, and a confirmation input button 2400.

The control panel 2000 may adjust various set values in relation to the operations of the refrigerator, based on the user's input. For example, the control panel 2000 may set a refrigerating compartment target temperature, a freezing compartment target temperature, a pantry compartment target temperature, a set value as to whether to operate each of the plurality of ice makers and/or in relation to the operation of each of the plurality of ice makers, and various set values in relation to convenience of use. The set value in relation to the operation of an ice maker may comprise the amount of ice that is generated per unit time. The various set values in relation to convenience of use may comprise information on whether a WiFi module operates, information on a temperature display unit (e.g., a selection of ° C. or ° F.), information on a method of displaying the states of various types of filters, information on whether a smart grid operates, the sort of information supplied to the user through a communication module and the like, and the like.

The input part may receive a user input and deliver the input to a controller (not illustrated). Though not illustrated, the control panel 2000 may comprise a controller (not illustrated). The controller (not illustrated) may comprise at least one processing unit and/or memory. The processing unit may comprise a central processing unit (CPU), a graphics processing unit (GPU), a microprocessor, an application-specific integrated circuit (ASIC), a field-programmable gate array (FPGA) and the like, for example, and may have a plurality of cores. Memory 1218 may be volatile memory (e.g., RAM and the like), non-volatile memory (e.g., ROM, flash memory and the like), or combinations thereof. A computer-readable instruction for embodying one or more of the embodiments set forth in the present disclosure or another computer-readable instruction for embodying an operation system, an application program and the like may be stored in the non-volatile memory. The computer-readable instructions stored in the non-volatile memory may be loaded on the volatile memory, to be executed by a processing unit. The controller (not illustrated) may comprise a micom where a processing unit, volatile memory and non-volatile memory are embodied as a single chip. In some embodiments, the controller (not illustrated) may further comprise additional memory (e.g., flash memory).

Figure 14:
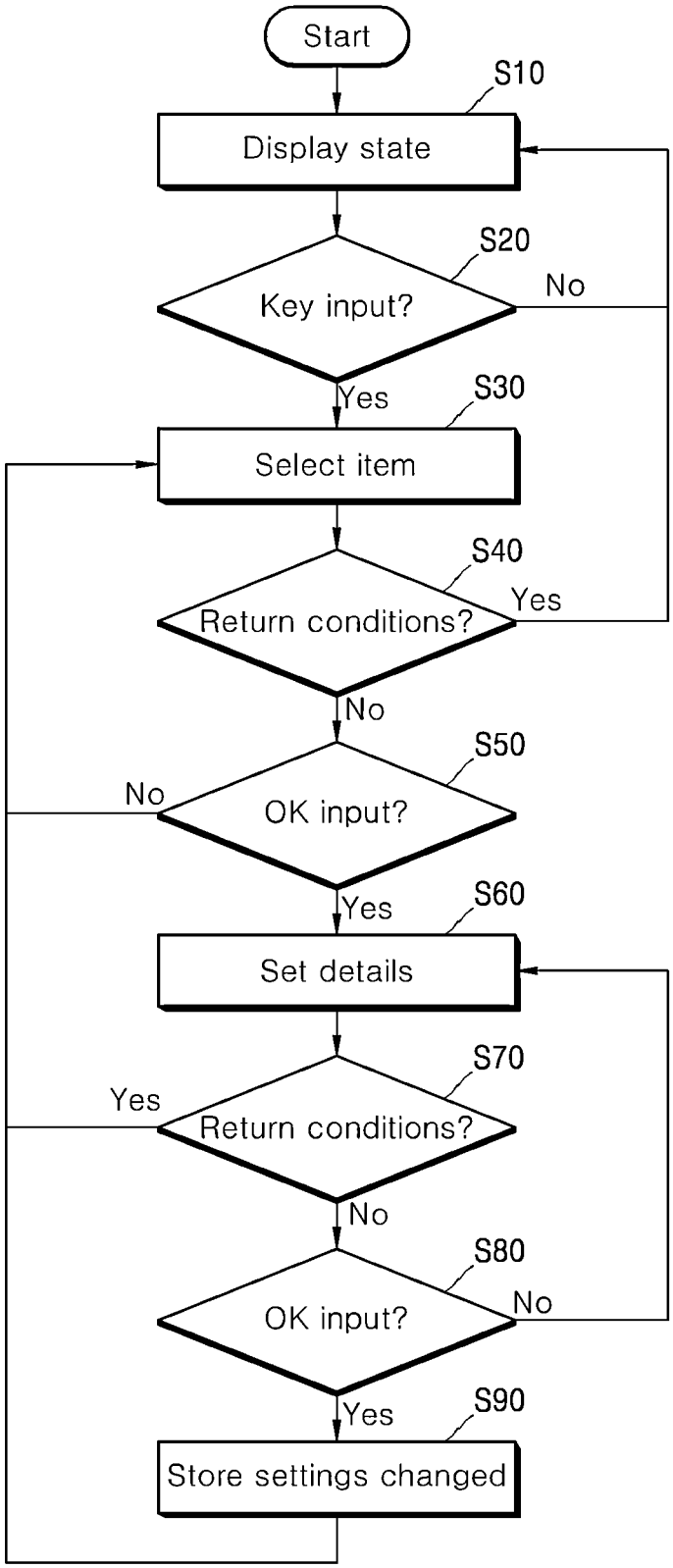
FIG. 14 is a flow chart for describing the operation of a control panel in FIG. 13.

FIG. 14 is a flow chart for describing the operation of a control panel 2000 in FIG. 13. Each step in FIG. 14 may be performed by the controller (not illustrated) of the control panel 2000. A method in FIG. 14 may be embodied through a program comprised of computer-readable instructions, and the program may be stored in the memory of the controller (not illustrated).

The state of the refrigerator may be displayed through the display part 2100 (step S10). For example, in step S10, a target temperature and/or current temperature of the refrigerating compartment 51 and the freezing compartment 52 may be displayed. The state displayed in the step of displaying a state, may be changed by the user.

Then it may be determined whether an input is provided to the input part 2200-2400 (step S20). If there is no input through the input part 2200-2400, step S10 may be maintained. If any input is provided through the input part 2200-2400, details for selecting an item may be displayed through the display part 2100 (step S30). In step S30, if the selection button 2300 is pressed, a configuration displayed on the display part 2100 may change. For example, in response to any one input to the selection button 2300, a refrigerating compartment temperature setting screen, a freezing compartment temperature setting screen, a pantry compartment temperature setting screen, an ice maker setting screen and the like may be displayed consecutively.

Then it may be determined whether return conditions are created (step S40). For example, if the return input button 2200 is pressed or no input is provided for a predetermined period of time, it can be found that the return conditions are created. If it is found that the return conditions are created, based on results of the determination in step S40, the refrigerator may return to step S10. If it is found that the return conditions are not created, based on results of the determination in step S40, it may be determined whether a confirmation input is provided (step S50). For example, it may be determined whether the confirmation input button 2400 is pressed.

If it is found that no confirmation input is provided, based on results of the determination in step S50, step S30 may be performed. If it is found that no confirmation input is provided, based on results of the determination in step S50, a detailed setting screen may be displayed on the display part 2100 (step S60). In step S60, a detailed setting value may change depending on an input through the selection button part 2300.

Then it may be determined whether the return conditions are created (step S70). For example, if the return input button 2200 is pressed or no input is provided for the predetermined period of time, it can be found that the return conditions are created. If it is found that the return conditions are created, based on results of the determination in step S70, the refrigerator may return to step S30. If it is found that the return conditions are not created, based on results of the determination in step S70, it may be determined whether a confirmation input is provided (step S80). For example, it may be determined whether the confirmation input button 2400 is pressed.

If it is found that no confirmation input is provided, based on results of the determination in step S80, step S60 may be performed. If it is found that the confirmation input is provided, based on results of the determination in step S80, a setting value, displayed on the display part 2100 at the time when it is found that the confirmation input is provided, may be stored (step S90), and step S30 may be performed.

Figure 15:
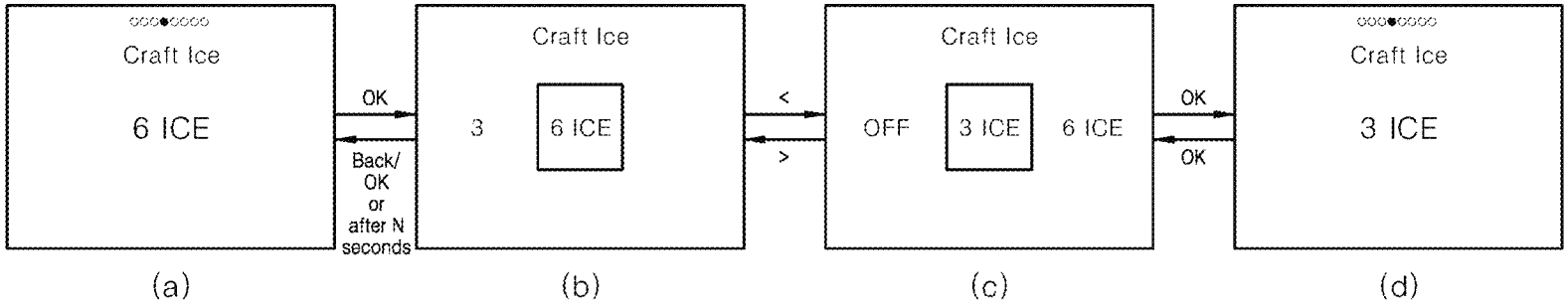
FIG. 15 is a view for describing the operation of the control panel in FIG. 13.

FIG. 15 is a view for describing the operation of the control panel in FIG. 13. FIG. 15 shows that a set value of the first ice maker 1100 changes. FIG. 15 (region a) and FIG. 15 (region d) may be an item selection screen displayed on the display part 2100 in step S30 of FIG. 14, and FIG. 15 (region b) and FIG. 15 (region c) may be a detailed setting screen displayed on the display part 2100 in step S60 of FIG. 14.

In the case where a key input is provided to a state display window (corresponding to step S20 in FIG. 14), as described with reference to FIG. 14, the item selection screen as shown in FIG. 15 (region a) may be displayed (corresponding to step S30 in FIG. 14). If the user wants to change the set value of the first ice maker 1100 in the state where a screen different from the screen in FIG. 15 (region a) is displayed on the display part 2100, the user may manipulate the selection input button 2300 to display the screen as shown in FIG. 15 (region a) on the display art 2100 (corresponding to step S30 in FIG. 14).

If the user presses the confirmation input button 2400 (corresponding to step S50 in FIG. 14) in the state where the screen as shown in FIG. 15 (region a) is displayed on the display part 2100, the detailed setting screen as shown in FIG. 15 (region b) may be displayed on the display part 2100 (corresponding to step S60 in FIG. 14). In this state, if the user presses the selection button 2300, the set value of the first ice maker 1100 may change, as shown in FIG. 15 (region b) and FIG. 15 (region c). The set value of the first ice maker 1100 may comprise the number of ice cubes (three or six ice cubes) that is produced per unit time (e.g., 24 hours), and the stop (off) of the operation of the first ice maker 1100.

If the user presses the confirmation input button 2400 (corresponding to step S80 in FIG. 14) in the state where the screen as shown in FIG. 15 (region c) is displayed, a value displayed on the display part 2100 may be stored (corresponding to step S90 in FIG. 14) at the time when the user presses the confirmation input button 2400, and the item selection screen as shown in FIG. 15 (region d) may be displayed on the display part 2100 (corresponding to step S30 in FIG. 14).

An aspect of the present disclosure is to provide a refrigerator that can provide ice having different shapes and/or sizes. The aspect of the present disclosure is to provide a refrigerator in which a plurality of ice makers is installed in a single space. The aspect of the present disclosure is to provide a refrigerator that ensures a uniform distribution of temperature in a single space where a plurality of ice makers is installed. The aspect of the present disclosure is to provide a refrigerator that can suppress the generation of frost in a single space where a plurality of ice makers is installed.

Aspects according to the present disclosure are not limited to the above ones, and other aspects and advantages that are not mentioned above can be clearly understood from the following description and can be more clearly understood from the embodiments set forth herein. Additionally, the aspects and advantages in the present disclosure can be realized via means and combinations thereof that are described in the appended claims.

A refrigerator of one embodiment may comprise a plurality of ice makers that is installed in a single space. The refrigerator may comprise a first ice maker and a second ice maker that are spaced from each other in a single space, and an air guide that discharges cold air to the first ice maker and the second ice maker respectively and between the first ice maker and the second ice maker.

The refrigerator may comprise a first ice maker and a second ice maker that are spaced from each other in a single space, and a distance between a lateral surface of the first ice maker, forming a surface adjacent to the second ice maker, and the second ice maker may increase as farther from a cold air outlet.

The refrigerator may comprise a first ice maker and a second ice maker that are spaced from each other in a single space, and a distance between a lateral surface of the second ice maker, forming a surface adjacent to the first ice maker, and the first ice maker, in a portion of the second ice maker, which is close to the cold air outlet, may be less than a distance between the lateral surface and the first ice maker, in a portion of the second icemaker, which is far from the cold air outlet.

A refrigerator of one embodiment comprises a freezing compartment having an outlet, through which cold air is discharged, on a rear surface thereof, a first ice maker being mounted on an upper surface of the freezing compartment, and a second ice maker being mounted on the upper surface of the freezing compartment in a way that the second ice maker is spaced from the first ice maker, and the refrigerator further comprises an air guide comprising a first air guide outlet that is disposed to overlap the outlet at least partially and guides a portion of cold air discharged from the outlet to the first ice maker, a second air guide outlet that guides a portion of cold air discharged from the outlet to the second ice maker, and a third air guide outlet that guides a portion of cold air discharged from the outlet between the first ice maker and the second ice maker, when viewed from a front.

In the refrigerator of one embodiment, the first ice maker may generate ice having a first shape, and the second ice maker may generate ice having a second shape different from the first shape. In the refrigerator of one embodiment, ice generated by the second ice maker may have a size less than a size of ice generated by the first ice maker.

In the refrigerator of one embodiment, the second ice maker may comprise a second ice maker fixation part being coupled to an upper surface of the refrigerator, and a second ice maker housing being disposed at a lower side of the second ice maker fixation part, and having a second ice maker outlet through which cold air is discharged, in an upper portion of a front surface thereof.

In the refrigerator of one embodiment, the second air guide outlet may comprise a second air guide upper outlet, and a second air guide lower outlet being disposed under the second air guide upper outlet. In the refrigerator of one embodiment, the second air guide lower outlet may discharge cold air to an upper portion of a tray in which ice is generated, in the second ice maker.

In the refrigerator of one embodiment, the first ice maker may be biased toward one side of the refrigerator, and the second ice maker may be disposed further toward a central portion of the refrigerator than the first ice maker, when viewed from the front. In the refrigerator of one embodiment, the first ice maker may comprise a first ice maker fixation part being coupled to the upper surface of the freezing compartment, and a first ice maker housing being disposed under the first ice maker fixation part and forming a first inner space, and the second ice maker may comprise a second ice maker fixation part being coupled to the upper surface of the freezing compartment, and a second ice maker housing being disposed under the second ice maker fixation part and forming a second inner space.

In the refrigerator of one embodiment, the first air guide outlet may discharge cold air to the first inner space, and the second air guide outlet may discharge cold air to the second inner space. In the refrigerator of one embodiment, a distance between one end far from the air guide, on a first lateral surface of the first ice maker housing, which is adjacent to the second ice maker, and the second ice maker may be greater than a distance between one end of the first lateral surface, which is adjacent to the air guide, and the second ice maker.

In the refrigerator of one embodiment, the first lateral surface may comprise a first lateral surface front part comprising a portion in contact with a front surface of the first ice maker housing, and a first lateral surface rear part comprising a portion in contact with a rear surface of the first ice maker housing, and a distance between the first lateral surface front part and the second ice maker may increase further toward the front.

In the refrigerator of one embodiment, the first lateral surface front part may have a curved surface shape, when viewed from above. In the refrigerator of one embodiment, a distance between one end close to the air guide, on a second lateral surface of the second ice maker housing, which is adjacent to the first ice maker, and the first ice maker may be greater than a distance between one end of the second lateral surface, which is far from the air guide, and the first ice maker.

In the refrigerator of one embodiment, the second lateral surface may comprise a second lateral surface front part comprising a portion in contact with a front surface of the second ice maker housing, and a second lateral surface rear part comprising a portion in contact with a rear surface of the second ice maker housing, and a distance between the second lateral surface rear part and the first ice maker may increase further toward a rear. In the refrigerator of one embodiment, the second lateral surface rear part may have a straight line shape, when viewed from above.

The refrigerator of one embodiment may further comprise a controller setting states of the first ice maker and the second ice maker. A refrigerator of one embodiment can provide a refrigerator that can provide ice having different shapes and/or sizes. In the refrigerator of one embodiment, a plurality of ice makers can be installed in a single space. The refrigerator of one embodiment can ensure a uniform distribution of temperature in the space where a plurality of ice makers is installed. The refrigerator of one embodiment can suppress the generation of frost in a single space where a plurality of ice makers is installed.

Specific effects are described along with the above-described effects in the section of detailed description. The embodiments are described above with reference to a number of illustrative embodiments thereof. However, embodiments are not limited to the embodiments and drawings set forth herein, and numerous other modifications and embodiments can be drawn by one skilled in the art within the technical scope of the disclosure. Further, the effects and predictable effects based on the configurations in the disclosure are to be included within the scope of the disclosure though not explicitly described in the description of the embodiments.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element (s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments are described herein with reference to cross-section illustrations that are schematic illustrations of idealized embodiments (and intermediate structures). As such, variations from the shapes of the illustrations as a result, for example, of manufacturing techniques and/or tolerances, are to be expected. Thus, embodiments should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator, comprising:

an ice making compartment having an outlet through which cold air is discharged, the outlet being provided on a rear surface of the ice making compartment;

a first ice maker that is mounted at an upper surface of the ice making compartment;

a second ice maker that is mounted at the upper surface of the ice making compartment, the second ice maker being spaced apart from the first ice maker; and an air guide that is positioned to overlap the outlet at least partially, the air guide comprising:

a first air guide outlet that guides a first portion of cold air discharged from the outlet to the first ice maker, a second air guide outlet that guides a second portion of cold air discharged from the outlet to the second ice maker, and a third air guide outlet that guides a third portion of cold air discharged from the outlet to a space between the first ice maker and the second ice maker.

2. The refrigerator of claim 1, wherein the first ice maker generates ice having a first shape, and the second ice maker generates ice having a second shape different from the first shape.

3. The refrigerator of claim 1, wherein ice generated by the second ice maker is smaller than ice generated by the first ice maker.

4. The refrigerator of claim 3, wherein the second ice maker includes:

a fixation bracket for the second ice maker coupled to the upper surface of the ice making compartment; and a housing for the second ice maker that is positioned below the fixation bracket for the second ice maker, and has an ice maker outlet through which cold air is discharged, the ice maker outlet being provided in an upper region of a front surface of the housing for the second ice maker.

5. The refrigerator of claim 4, wherein the second air guide outlet includes:

an air guide upper outlet; and an air guide lower outlet positioned under the air guide upper outlet.

6. The refrigerator of claim 5, wherein the second air guide lower outlet discharges cold air to an upper surface of a tray in which ice is generated in the second ice maker.

7. The refrigerator of claim 1, wherein, when viewed from the front, the second ice maker is positioned closer to a center of the ice making compartment than the first ice maker.

8. The refrigerator of claim 7, wherein the first ice maker includes:

a first ice maker fixation bracket that is coupled to the upper surface of the ice making compartment; and a first ice maker housing that is positioned under the first ice maker fixation bracket and forms a first inner space in which ice is formed in the first ice maker, wherein the second ice maker includes:

a second ice maker fixation bracket that is coupled to the upper surface of the ice making compartment; and a second ice maker housing that is positioned under the second ice maker fixation bracket and forms a second inner space in which ice is formed in the second ice maker.

9. The refrigerator of claim 8, wherein:

the first air guide outlet discharges cold air to the first inner space, and the second air guide outlet discharges cold air to the second inner space.

10. The refrigerator of claim 8, wherein:

the first ice maker housing includes a first lateral surface facing the second ice maker, the first lateral surface includes a first end and a second end, the second end being relatively closer to the air guide than the first end, and a first distance between the first end of the first lateral surface and the second ice maker is greater than a second distance between the second end of the first lateral surface and the second ice maker.

11. The refrigerator of claim 10, wherein the first lateral surface of the first ice maker housing includes:

a first lateral surface front region in contact with a front surface of the first ice maker housing; and a first lateral surface rear region in contact with a rear surface of the first ice maker housing, and wherein a distance between the first lateral surface front region and the second ice maker increases in a direction away from the air guide.

12. The refrigerator of claim 11, wherein the first lateral surface front region has a curved surface shape when viewed from above.

13. The refrigerator of claim 8, wherein:

the second ice maker housing includes a lateral surface facing the first ice maker, the lateral surface includes a first end and a second end, the first end being relatively closer to the air guide than the second end, and a first distance between the first end of the lateral surface and the first ice maker is greater than a second distance between the second end of the lateral surface and the first ice maker.

14. The refrigerator of claim 13, wherein the lateral surface includes:

a lateral surface front region in contact with a front surface of the second ice maker housing; and a lateral surface rear region in contact with a rear surface of the second ice maker housing, wherein a distance between the lateral surface rear region and the first ice maker increases in a direction toward the air guide.

15. The refrigerator of claim 14, wherein the lateral surface rear region has a straight line shape, when viewed from above.

16. The refrigerator of claim 1, wherein the refrigerator further comprises:

a user interface to receive an input; and a controller that manages the first ice maker and the second ice maker based on the input.

17. The refrigerator of claim 1, wherein the ice making compartment is included in a door of the refrigerator.

18. The refrigerator of claim 1, wherein the ice making compartment is included in a freezing compartment of the refrigerator, and the outlet is provided in a grille fan assembly grille provided on a rear surface of the freezing compartment.

19. A refrigerator, comprising:

an ice making compartment;

a first ice maker that is mounted in the ice making compartment;

a second ice maker that is mounted in the ice making compartment and is spaced apart from the first ice maker; and an air guide including:

a first air guide outlet that outputs a first flow of cold air into the first ice maker, a second air guide outlet that outputs a second flow of cold air into the second ice maker, and a third air guide outlet that outputs a third flow of cold air between the first ice maker and the second ice maker, wherein the second ice maker includes a tray to generate ice, and wherein the second air guide outlet includes:

an air guide upper outlet; and an air guide lower outlet that is positioned under the air guide upper outlet and that discharges cold air to an upper surface of the tray.

* * * * *